US010874157B2

(12) United States Patent
Miniello et al.

(10) Patent No.: US 10,874,157 B2
(45) Date of Patent: Dec. 29, 2020

(54) METHOD AND DEVICE FOR EXTENDING STRANDS OF A PERSON'S OWN

(71) Applicant: NOU HAIR GmbH, Duesseldorf (DE)

(72) Inventors: Luigi Miniello, Cologne (DE); Sebastian Mader, Hilden (DE)

(73) Assignee: NOU HAIR GmbH, Duesseldorf (DE)

( * ) Notice: Subject to any disclaimer, the term of this patent is extended or adjusted under 35 U.S.C. 154(b) by 1138 days.

(21) Appl. No.: 14/442,616

(22) PCT Filed: Dec. 4, 2013

(86) PCT No.: PCT/EP2013/003651
§ 371 (c)(1),
(2) Date: Aug. 22, 2016

(87) PCT Pub. No.: WO2014/086483
PCT Pub. Date: Jun. 12, 2014

(65) Prior Publication Data

US 2016/0345648 A1 Dec. 1, 2016

(30) Foreign Application Priority Data

Dec. 5, 2012 (DE) ..... 10 2012 023 735

(51) Int. Cl.
*A41G 5/00* (2006.01)

(52) U.S. Cl.
CPC ..... *A41G 5/0066* (2013.01); *A41G 5/008* (2013.01)

(58) Field of Classification Search
CPC ..... A41G 5/00; A41G 5/0013; A41G 5/002; A41G 5/0026; A41G 5/0033; A41G 5/004; A41G 5/0046; A41G 5/0053; A41G 5/006; A41G 5/008; A41G 5/0066
See application file for complete search history.

(56) References Cited

U.S. PATENT DOCUMENTS

| | | | | |
|---|---|---|---|---|
| 5,107,867 | A | 4/1992 | Barrington | |
| 5,894,846 | A | 4/1999 | Gang | |
| 7,610,921 | B2 * | 11/2009 | Gold | A41G 5/0046 132/201 |
| 8,025,065 | B2 * | 9/2011 | Guliker | A41G 5/0066 132/201 |
| 2002/0185146 | A1 | 12/2002 | Gold | |

(Continued)

FOREIGN PATENT DOCUMENTS

| | | | |
|---|---|---|---|
| DE | 20009406 | U | 9/2000 |
| EP | 2928334 | B1 | 6/2018 |
| JP | 2005-200802 | A * | 7/2005 |

OTHER PUBLICATIONS

Langenscheidt German/English dictionary.

(Continued)

*Primary Examiner* — Rachel R Steitz
*Assistant Examiner* — Brianne E Kalach
(74) *Attorney, Agent, or Firm* — Andrew Wilford

(57) ABSTRACT

The invention relates to a method for extending strands of a person's own hair (E) by means of foreign hair strands (1) with the aid of an external shrinking sleeve (3) which surrounds the hair joining point and in which the strands of a person's own hair, the foreign hair strands and a glue (2) are located, wherein after the shrinkage of the shrinking sleeve (3) said sleeve is removed from the connection point.

8 Claims, 10 Drawing Sheets

(56) References Cited

U.S. PATENT DOCUMENTS

| | | | | |
|---|---|---|---|---|
| 2004/0149301 | A1* | 8/2004 | Arroyo | A41G 5/0066 132/201 |
| 2004/0149302 | A1* | 8/2004 | Toda | A41G 5/0046 132/201 |
| 2004/0173233 | A1* | 9/2004 | Tokko | A41G 5/0066 132/201 |
| 2005/0011530 | A1 | 1/2005 | Chang | |
| 2005/0081873 | A1* | 4/2005 | Chung | A41G 5/0086 132/201 |
| 2006/0027244 | A1 | 2/2006 | Nomura | |
| 2009/0188514 | A1* | 7/2009 | Hsu | A41G 5/008 132/201 |
| 2011/0247643 | A1* | 10/2011 | Tokko | A41G 5/0066 132/201 |

OTHER PUBLICATIONS

Duden Oxford German/English.
Michael D.Larranaga, Richard J. Lewis, Sr, Robert A. Lewis, Hawley's Condensed Chemical Dictionary, Sixteenth Edition, John Wiley & Sons, Inc, Hoboken, New Jersey.

* cited by examiner

METHOD AND DEVICE FOR EXTENDING STRANDS OF A PERSON'S OWN

CROSS REFERENCE TO RELATED APPLICATIONS

This application is the US-national stage of PCT application PCT/EP2013/003651 filed 4 Dec. 2013 and claiming the priority of German patent application 102012023735.9 itself filed 5 Dec. 2012.

FIELD OF THE INVENTION

The invention relates to a method of extending natural hair with foreign hair strands, with the aid of an external shrink sleeve that surrounds the hair at a connection site where the strand of a person's own hair, the foreign hair strand, and a glue are located.

BACKGROUND OF THE INVENTION

From the German utility model 200 09 406, it is known, for connecting two strands of hair, to use a sleeve that shrinks when heat is applied such that a hot-melt adhesive located in the sleeve becomes plastic and binds the hairs to each other. After setting, the sleeve remains in the hair on the head, as a result of which the connection point has large external dimensions and can be easily seen.

OBJECT OF THE INVENTION

The object of the invention is to improve a method and an apparatus for extending a person's own hair in such a way that, along with simple and rapid handling, it is possible to achieve very small dimensions of the connection site, as a result of which the connection sites are barely visible. Moreover, after the connection has been produced, modeling of the hot connection site between two fingers should not be necessary, since a perfect shape of the connection site is provided by the shrink sleeve. Thus, there should also be no burning of the fingers.

SUMMARY OF THE INVENTION

According to the invention, this object is achieved by the fact that, after the shrinkage of the shrink sleeve, the latter is removed from the connection site. The glue, heated by the heating of the shrink sleeve, turns to liquid and penetrates the hairs of both strands of hair. A method is thus afforded by which, along with very simple and rapid handling, very small dimensions of the connection site are achieved with a firm hold. The shrink sleeve can in this case be removed immediately after the shrinkage or during or after the wearing of the foreign hair.

A particularly simple method of removing the shrink sleeve, and one that is easy and quick to carry out, is achieved if the shrink sleeve is removed by being torn open. Alternatively or in addition, however, and with the same advantages, the shrink sleeve can also be removed by being pulled over the foreign hair strand.

A particularly advantageous apparatus for adding extensions to natural hair is created if the shrink sleeve has at least one or preferably two predetermined break points extending along its length, in particular one or two longitudinal notches or longitudinal grooves or a perforation or longitudinal incisions, in order to make it easier to tear open the shrink sleeve so as to remove it. Handling is made even easier by the fact that, at least at one end of the shrink sleeve, the latter has a projecting grip tab on both opposite sides for tearing the shrink sleeve open. The one or more grip tabs directed toward the head can project radially to such an extent that they provide a heat protection shield in relation to the top of the head.

A connection of the strand of a person's own hair to the foreign hair strand is made much easier if the ends of the foreign hairs of the end of the foreign hair strand directed toward the head lie in a glue accumulation that is located as a prefabricated glue head of the foreign hair strand inside the shrink sleeve. The foreign hair strands are thus already provided with glue heads applied to their end directed toward the scalp, such that the strand of a person's own hair simply has to be connected to the glue inside the shrink sleeve. The glue accumulation as prefabricated glue head can have the shape of a solid profile or of a sleeve that lies coaxially and in particular with a form fit and/or force fit in the shrink sleeve.

It is preferably proposed that the plastic material of the shrink sleeve is shrunk by application of heat. The plastic material of the shrink sleeve can be mechanically stretched at least in the area of the glue accumulation, in particular in the area of the glue sleeve. Simple production is permitted if the shrink sleeve is formed from a portion of a shrink tube or from a roll of shrink film.

Pulling a person's own hair into the shrink sleeve is made easier by a hook wire whose width is equal to or smaller than the inner area that is held free from the glue and is used for pulling the strands of a person's own hair through the apparatus. Preferably, the hook has a closure mechanism such as a carabiniere mechanism, a movable sleeve or a closure lever. It is also possible for two or more apparatuses and/or hook wires to be mechanically connected to one another.

Two or more foreign hair strands are secured easily and quickly by two or more shrink sleeves being connected to one another, in particular releasably, for extending and/or thickening two or more strands of a person's own hair. Two or more shrink sleeves can be secured, in particular releasably, on a body or support. The shrink sleeves can also be formed by a one-part body.

Handling that is particularly easy and saves time is permitted if two or more shrink sleeves are formed by one shrinking body that has two or more mutually parallel passages in which the sleeve-shaped glues each lie. It is of advantage here if the shrinking body is removed after the person's own hairs and the foreign hairs have been glued to one another, and that the shrinking body has predetermined fracture zones between the passages. It is also proposed in this connection that a predetermined fracture zone extends through two or more passages, and each passage can be split at a respective predetermined fracture zone.

It is preferably proposed that the shrinking body has two body halves that bear on each other and that each form half passages and are held on each other by securing means in order to achieve a reduction of the passage cross sections upon shrinkage.

It is further proposed that the shrink sleeve, outside the glue area, is formed by a material that has no shrink effect or a low shrink effect. The shrink sleeve, outside the glue area, can also be held by mechanical brace that completely or partially prevent shrinkage.

The procedure is made considerably easier if a support apparatus is located inside the shrink sleeve, at least in the glue area, which support apparatus holds the shrink sleeve in its wider, non-shrunken state and yields and/or is removed after the person's own hairs have been pulled in. For this purpose, the mechanical brace can be a split sleeve or a coil. The support apparatus can also be formed by the sleeve-shaped body.

It is advantageous if the material of the shrink sleeve reduces in its longitudinal direction when heat is applied. It is also proposed that the shrink sleeve and/or the shrinking body has heating elements that cause the shrinkage of the shrinking body. In this way, the shrink sleeves and/or the shrinking body can be used several times or again and again, in particular as part of a tool.

BRIEF DESCRIPTION OF THE DRAWING

Advantageous embodiments of the invention are described in more detail below and are shown in the drawing, in which.

SPECIFIC DESCRIPTION OF THE INVENTION

Figures 1, 2:
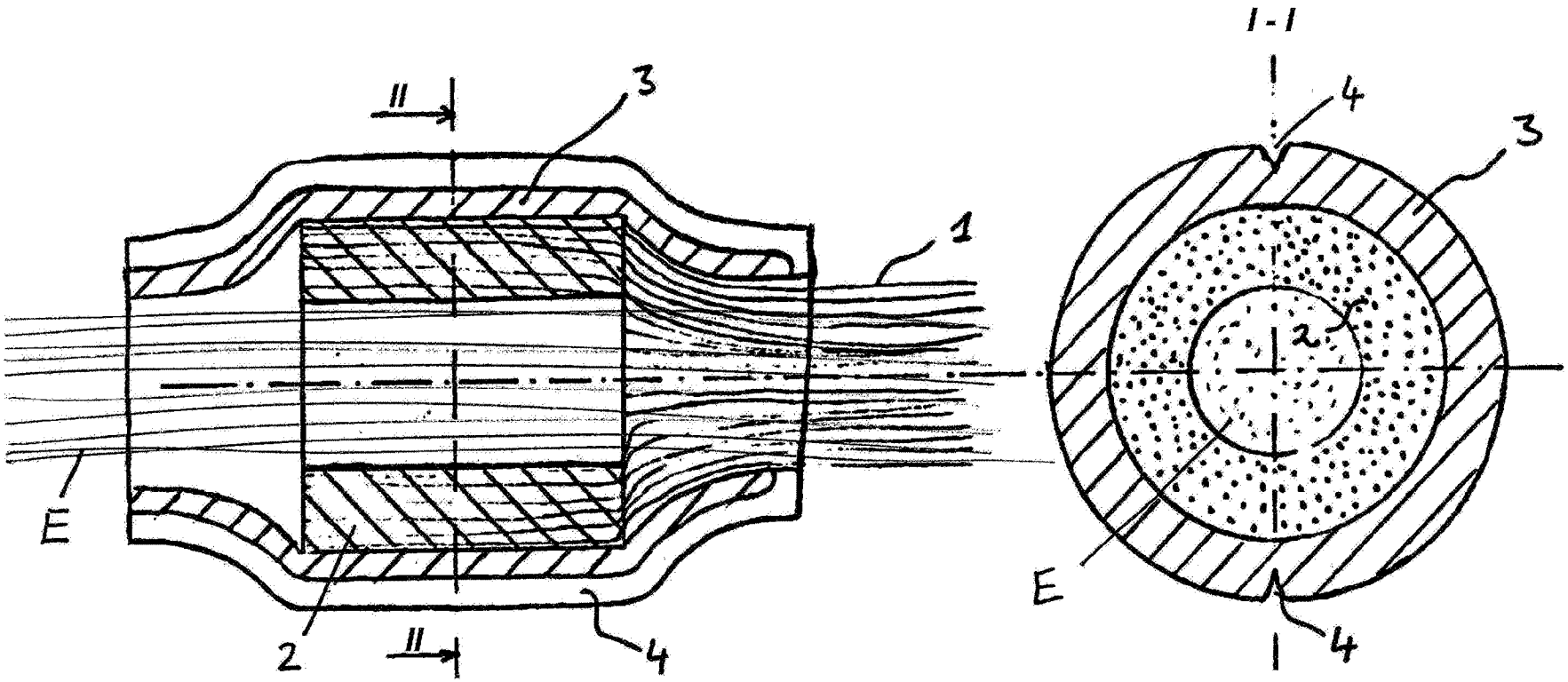
FIG. 1 is a longitudinal section through a shrink sleeve without an inserted strand of a person's own hair.
FIG. 2 is a cross section through the shrink sleeve according to A-A in FIG. 1.
Figure 3:
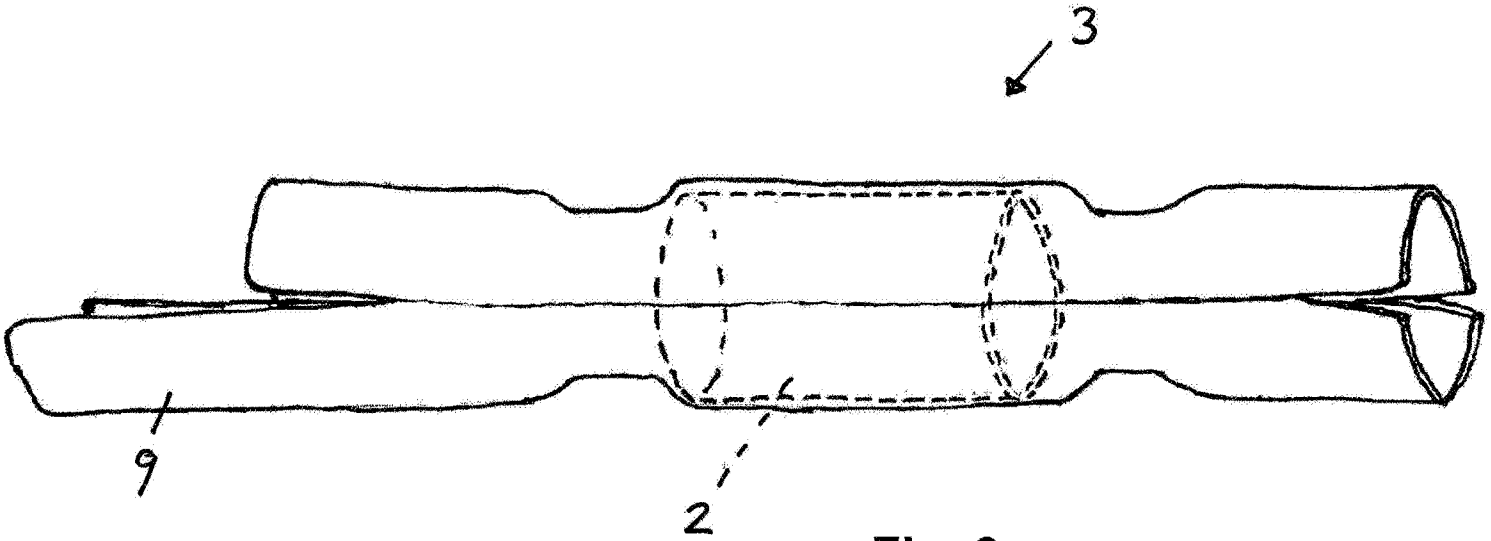
FIG. 3 is a perspective view of a shrink sleeve.
Figure 4:
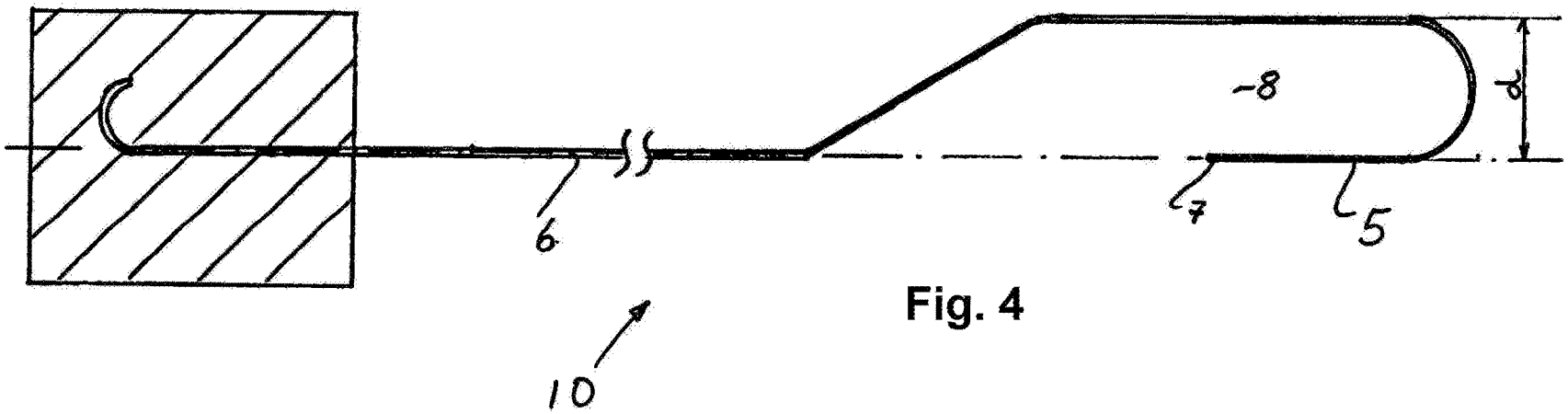
FIG. 4 is a view of a hook wire.
Figure 5:
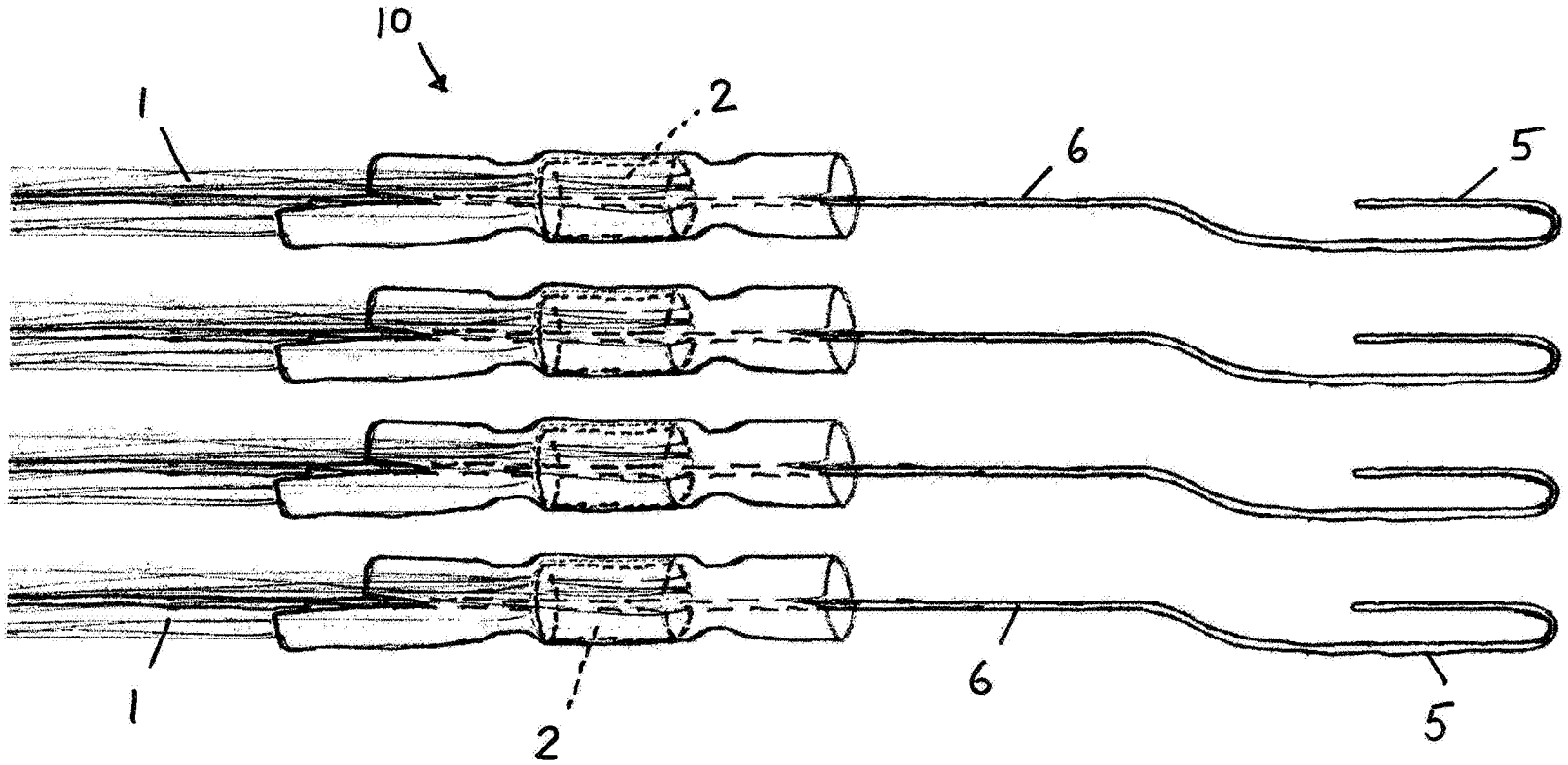
FIG. 5 shows several shrink sleeves secured alongside one another with already inserted foreign hair strands and hook wires, before this arrangement, as a battery with its hook wires, grasps strands of a person's own hair (without showing the securing means between the shrink sleeves and/or between the hook wires)

To extend a person's own head of hair, the method and the apparatus do not generally use individual head hairs, but several hairs simultaneously, hereinafter called the strands E of a person's own hair. Foreign hair strands are glued onto the strands E of a person's own hair. For this purpose, the end of the foreign hair strand 1 directed toward the scalp is preferably first of all provided with glue, such that this end of the foreign hair strand 1 forms a glue head 2. An important advantage of the invention is that the foreign hair strands can be prefabricated with such glue heads 2, as a result of which handling is made easier and more precise. This end of the foreign hair strand is thus provided, in particular saturated, with a glue, in particular a thermoplastic substance, e.g. keratin, preferably in the shape of a sleeve 2 closed about its circumference. The latter is referred to hereinbelow as the glue sleeve 2.

The glue sleeve, with its inserted hair ends of the foreign hair strand 1, can be profiled on the outside and on the inside, both about its circumference and also along its length. The thermoplastic glue is in a solid state at room temperature, such that the glue sleeve is mechanically stable.

One important aspect is the combination of a foreign hair sleeve with a shrink sleeve for tearing, such that only the shrunk-on foreign hair sleeve remains on the person's own hair.

The glue sleeve 2 is encapsulated by a further sleeve 3 made of elastic material. This sleeve is referred to hereinbelow as the shrink sleeve. The shrink sleeve 3 is longer than the glue sleeve 2 and projects beyond the latter at both ends. The shrink sleeve 3 can be profiled on the outside and on the inside, both about its circumference and also along its length.

The shrink sleeve is formed by a portion of a shrink tube or a roll of shrink film.

The shrink sleeve 3 has at least one outer notch 4 that extends along the entire length of the sleeve. This notch serves at a later stage as a predetermined break point.

To be able subsequently to perform its main task, i.e. shrinkage, the shrink sleeve 3 has to be prestressed along its circumference. This can be achieved, on the one hand, macroscopically, since the nominal external diameter of the glue sleeve 2 is greater than the nominal internal diameter of the shrink sleeve 3. Thus, when the glue sleeve is pushed into the shrink sleeve, the circumference of the shrink sleeve is stretched and a mechanical prestressing along the circumference is obtained. A shrink sleeve of this kind can be made, for example, from a plastic such as silicone (thermoplastics, thermosetting plastics, elastomers, thermoplastic elastomers, etc.). On the other hand, prestressing can be applied at a molecular level, similar to the principle of a shrink tube. Thus, the prestressing becomes effective only when the shrink sleeve is exposed to an elevated temperature. Such a shrink sleeve can be made, for example, of a thermoplastic.

On one or both of its end faces, the shrink sleeve preferably has grip tabs 9 with which the shrink sleeve 3 can be easily grasped and torn. Moreover, on the side from which no foreign hairs emerge, the shrink sleeve can have one or more tabs that, during the heating of the shrink sleeve, serve as a heat protection shield in relation to the top of the head.

A hook 5 with pulling rod 6 is guided through the inner opening of shrink sleeve and glue sleeve 2. This catching hook is referred to hereinbelow as the hook wire 10. The hook wire is oriented in the sleeves 2, 3 such that its opening projects from the shrink sleeve on the side on which there are no foreign hairs. On the other side, the pulling rod 6 emerges from the shrink sleeve.

The hook wire is configured such that it can be pulled through the shrink sleeve and glue sleeve. In particular, its external diameter d must be less than or equal to the internal diameter of the shrink sleeve. Furthermore, the hook wire is configured such that a hook tip 7 does not project from the pulling rod 6 of the hook. In this way, an unwanted hooking of the hook in the sleeves is avoided when the hook is pulled out of these.

Hook wires 10 can be used singly, for pulling through a single strand of a person's own hair, or also severally, for simultaneously pulling through several strands of a person's own hair. In order to permit simple handling during simultaneous use of several hook wires 10, they can be mechanically connected to one another on the side of the pulling rods 6.

In a further embodiment, the hook wire has a closure mechanism that permits closure of the hook 8, such that a person's own hairs that have been hooked in can be handled safely against loss and also separately from other hairs. The closing of the hook 8 can take place by lever from the inside or outside of the hook.

Figure 6:
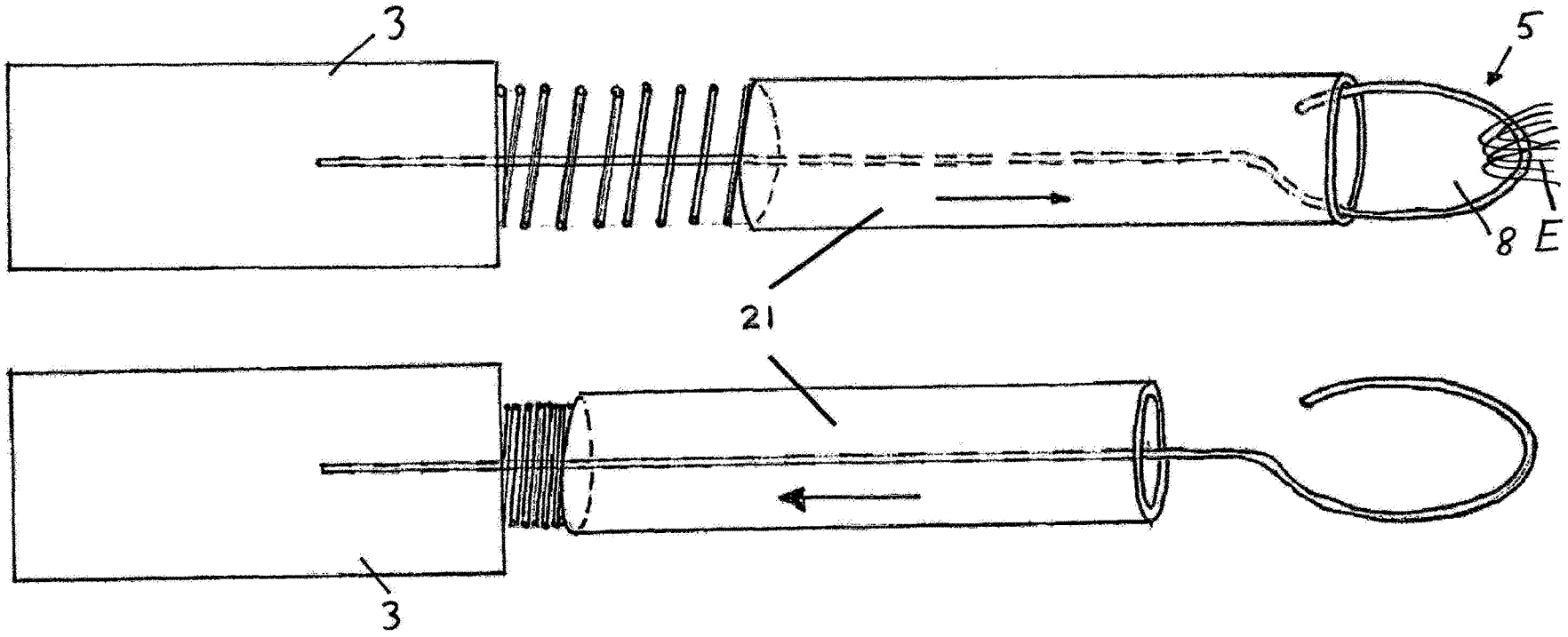
FIG. 6 shows a hook wire with a sleeve movable thereon, which sleeve clamps a person's own hair on the hook in a clamping and opened position.
Figure 7:
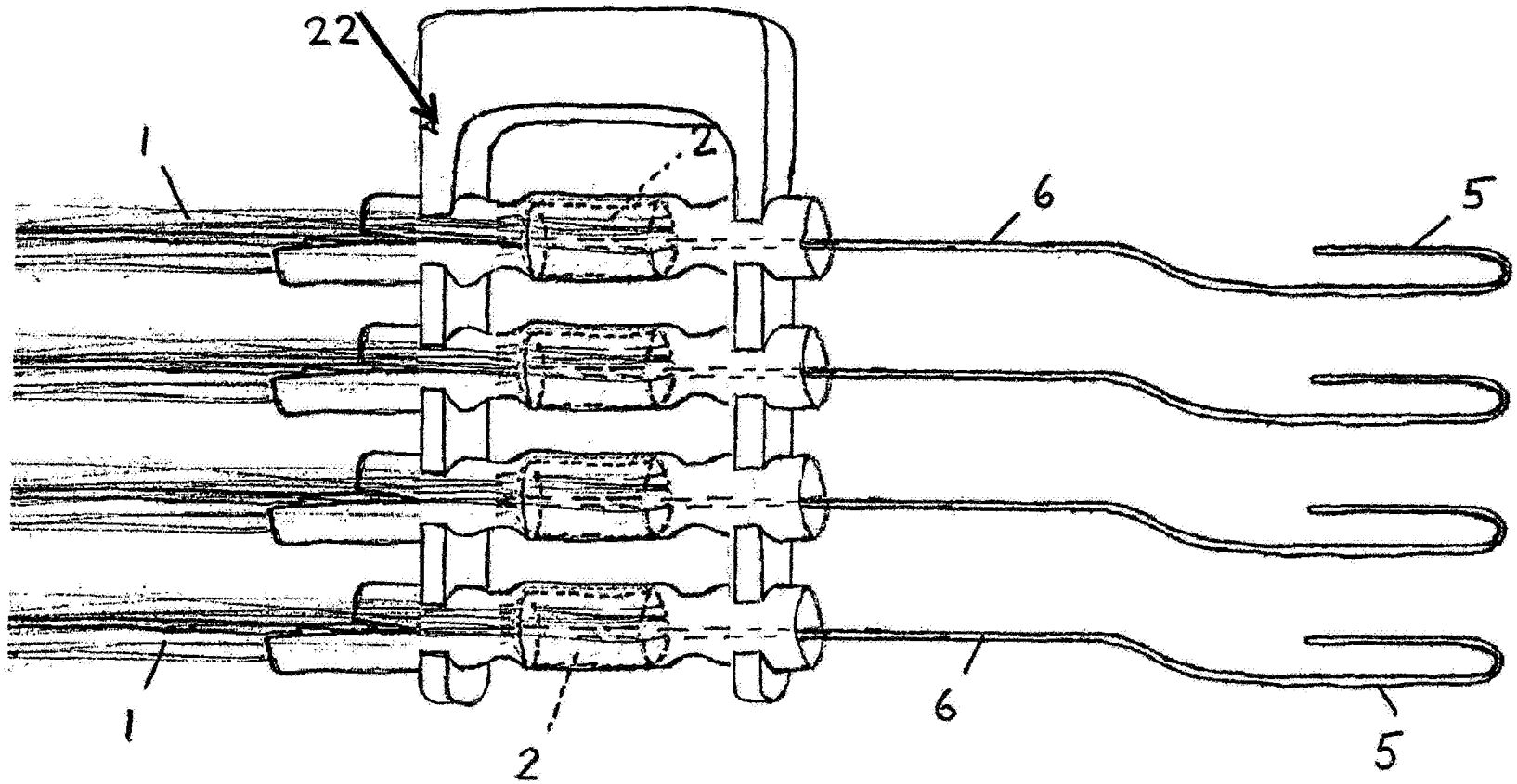
FIG. 7 shows a U-shaped body on which several shrink sleeves are secured releasably or non-releasably.

The closure is also possible by a further sleeve that is moved by a helical compression spring F in the direction of the hook 5. As FIG. 6 shows, the sleeve 21 is pushed onto the pulling rod 6 near the hook 5 and is pushed together with the pulling rod 6 into the shrink sleeve 3, such that the hook 5 then safely grasps the person's own hairs E, since the sleeve 21 is pushed so far over the hook 5 that the sleeve 21 holds the person's own hairs securely in the hook eye 8. Thereafter, the hook 5 and the sleeve 21 and the person's own hairs E are pulled into the shrink sleeve 3 and into the sleeve-shaped glue in which the foreign hairs 1 are already located. The pulling rod 6 and the hook 5 are pulled further in the same direction until they are removed from the shrink sleeve 3. Thereafter, the shrink sleeve 3 and the glue 2 are heated and, after the connection has been made, the shrink sleeve is removed.

Moreover, the hook can have a carabiniere mechanism that allows the hook to open toward the hook eye 8 in order to insert a person's own hair. By means of the force-induced closure of the carabiniere hook, the hooked-in hairs are caught safely against loss. In addition, this suppresses the inadvertent insertion of foreign hairs during the pulling-through process. This also makes it possible to maintain the separation of strands of a person's own hair and strands of foreign hair after the pulling-through process. To sample strands of a person's own hair, a row of hairs on the head is first separated, by the hairs lying over this being lifted using commercially available hair clasps.

The hairs located under the row of hairs that is to be separated off are held down by at least one hair clasp. Moreover, the resulting separation of the row of a person's own hair from the hairs lying above and below same prevents the person's own hairs from being pulled into the foreign hair sleeve, without adjoining own hairs accidentally being pulled in.

To heat the shrink sleeve 3 and the glue, in particular the glue sleeve 2, a heating clasp or heating tong with small external dimensions is pushed onto the apparatus or clamped. When using a geometrically prestressed shrink sleeve 3, the heating tong mainly heats only the area of the shrink sleeve in which the glue sleeve 2 is located. When using a molecularly prestressed shrink sleeve, the heating clasp heats the shrink sleeve beyond the length of the glue sleeve, so as to cause a shrinkage of the shrink sleeve in front of and also behind the foreign hair sleeve.

A hair section is marked out in the form of a hair row, by hair lying above being held up by conventional hair clasps and by hair lying below being held down by holding-down clasps. One or more glue sleeves 2 with encapsulating shrink sleeve 3 are pushed onto one or more hook wires 10, such that the hooks project clearly from the front end of the shrink sleeve. The one or more catching hooks are now guided through the extended section, and hairs of the section are guided into the one or more catching hooks, where they from now on form a strand of a person's own hair. The one or more catching hooks are preferably positioned and fixed on the latch points of the holding-down clasp.

Next, the shrink sleeves are pushed from behind forward over the catching hooks toward the scalp and then, by pulling on the pulling rods the strands of a person's own hair are pulled through the glue sleeve. The sleeves are preferably configured such that they are easily movable on the strand of a person's own hair but do not slip under their own weight from the strands of a person's own hair. If necessary, the sleeves can be easily pulled off without residue and can be placed at a new position.

Finally, the heating clasp is positioned on the shrink sleeve and heats the latter. The thermoplastic material of the glue sleeve softens. The shrink sleeve contracts on account of its prestressing, as a result of which the glue sleeve is shrunk onto the strand of a person's own hair. A perfect join is formed. The join is individually configured in the longitudinal direction and circumferential direction depending on the shape of the shrink sleeve.

The heating clasp is removed. After a short period, the join has cooled and the thermoplastic material hardens again. By pulling in opposite directions, the shrink sleeve is torn along the entire length of its notch, and the join is thus exposed. The hair clasps are removed.

Figure 8:
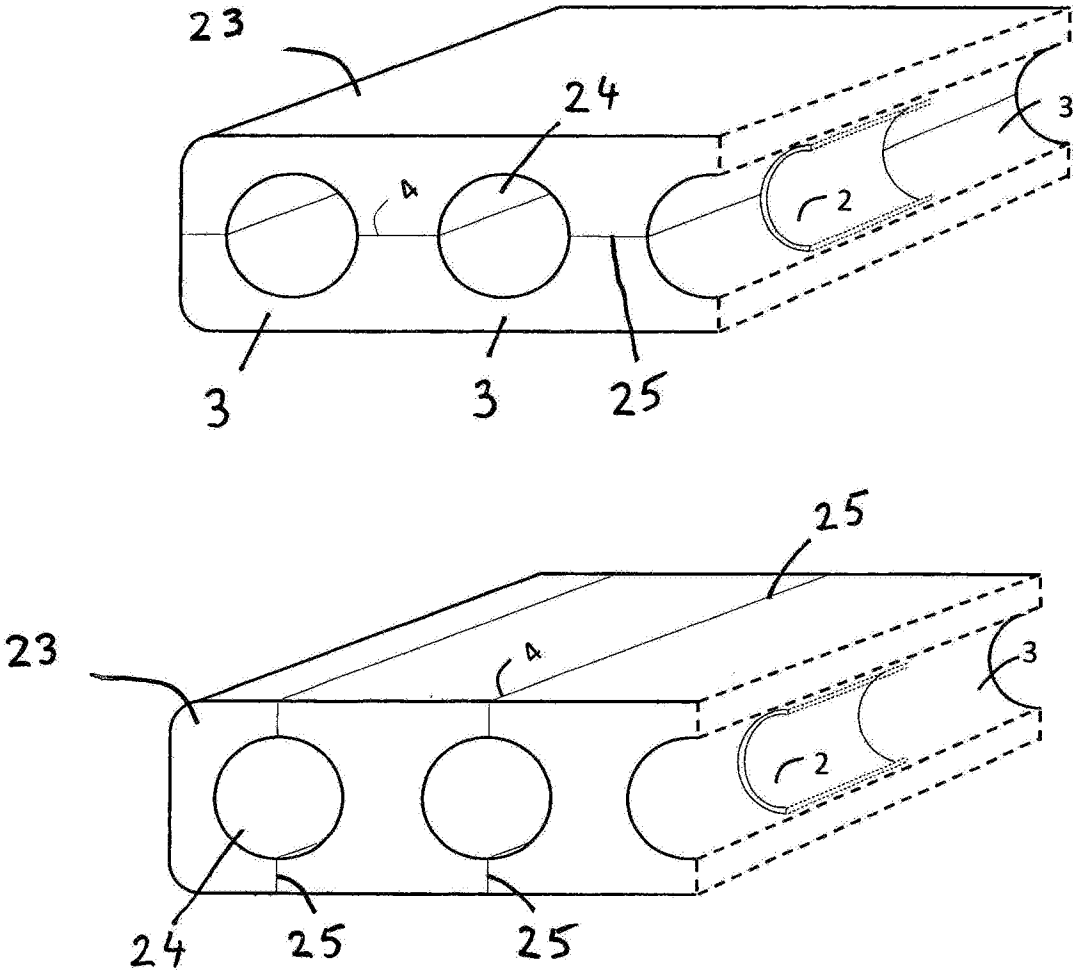
FIG. 8 shows a shrinking body forming several shrink sleeves, with predetermined fracture zones arranged along or transverse to the extent of the body.
Figure 9:
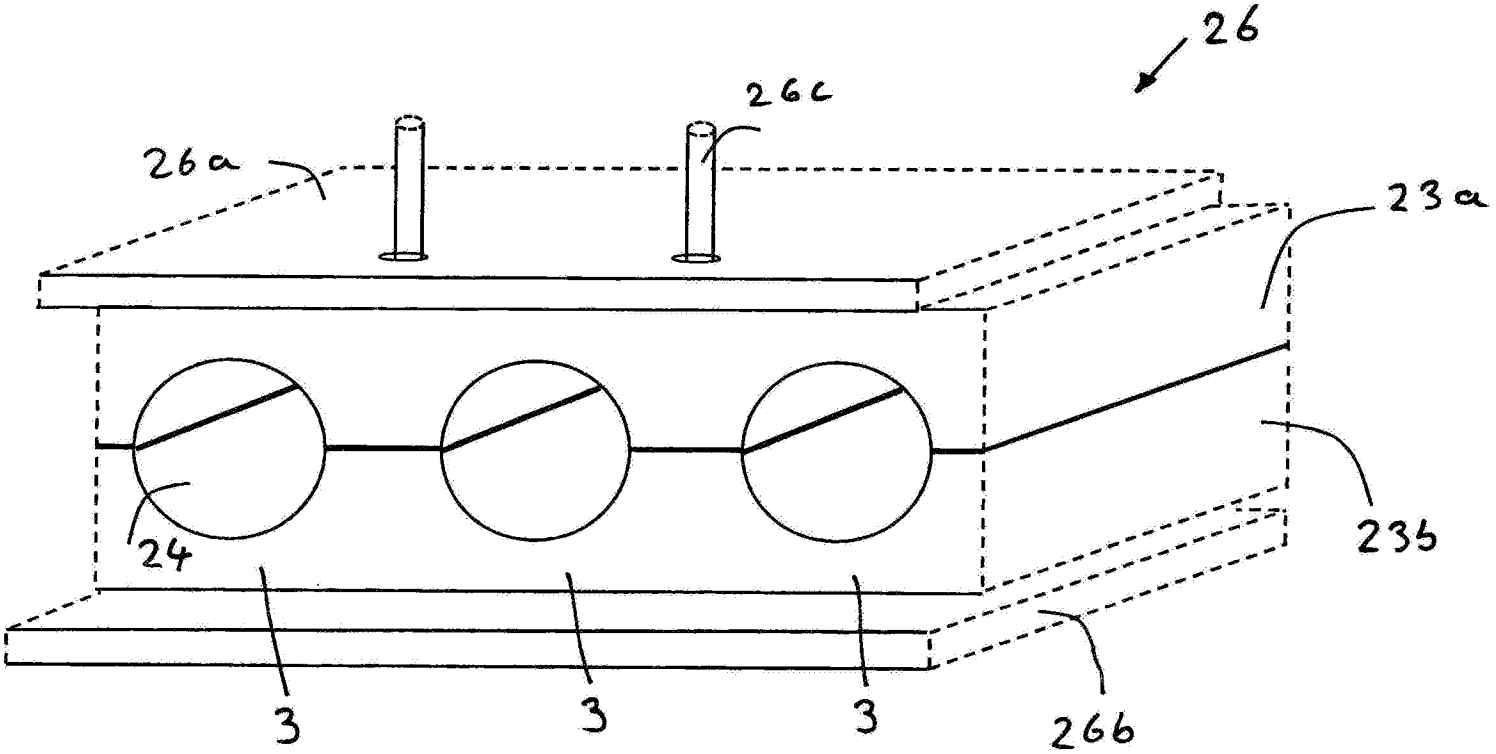
FIG. 9 shows a two-part shrinking body between securing surfaces in the assembled state.
Figure 10:
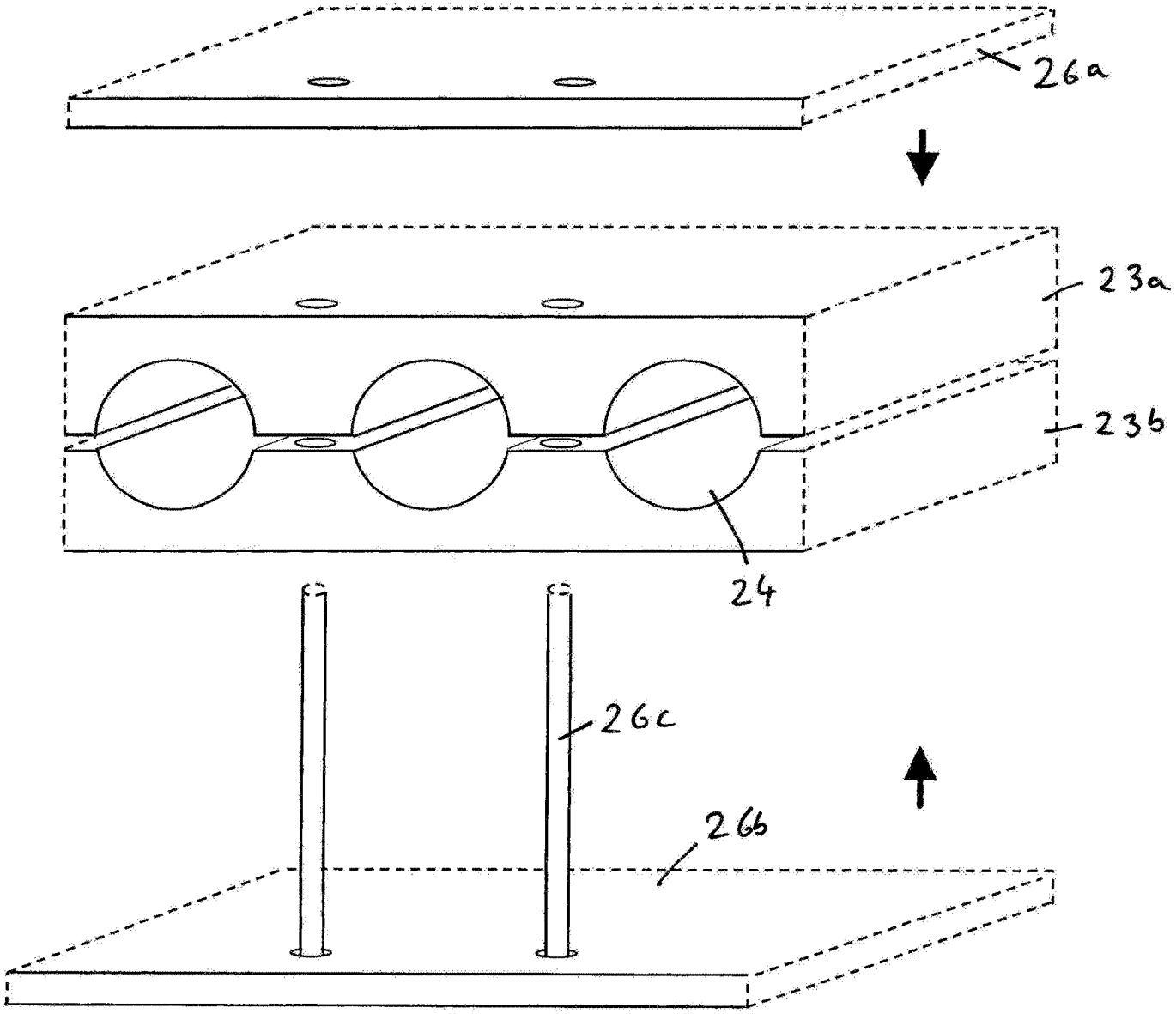
FIG. 10 shows the shrinking body according to FIG. 9 in the dismantled state.

FIGS. 7 to 10 show that several shrink sleeves 3, in particular with hook wires 10, are secured releasably or non-releasably alongside one another and in this way a reusable tool 22, 23 is formed that makes working much easier and much quicker. The shrink sleeves 3 are either secured releasably or nonreleasably on a support 22 (FIG. 7) or all the shrink sleeves are part of a one-piece shrinking body 23 (FIGS. 8 to 10).

As is shown in FIG. 8, the shrinking body 23 has the shape of a flat plate that forms the shrink sleeves 3 alongside one another and parallel to one another, wherein the number of the shrink sleeves is preferably 3 to 10, and the hollow cylindrical glue 2 lies in the cylindrical cavity of each shrink sleeve.

After the shrinkage of the shrink sleeves 3, the shrinking body 23 is separated from the hair connection sites by the shrinking body 23 being subdivided along a predetermined fracture zone 25 into the upper half and lower half. The predetermined fracture zone 25 thus separates all the passages 24 of the shrink sleeves 3 into an upper and a lower passage half.

In the illustrative embodiment shown in the bottom picture in FIG. 8, the predetermined fracture zones 25 extend at right angles to the longitudinal extent of the flat shrinking body 23, wherein each predetermined fracture zone extends through a respective shrink sleeve 3 and therefore through a passage 24 and thus separates each passage lengthwise into two halves. In both cases, the hairs with the finished hair connection sites can be removed from the shrinking body.

The illustrative embodiment according to FIGS. 9 and 10 differs from the one according to FIG. 8 in that the shrinking body 23 consists, from the outset, of a separated upper half 23*a* and lower half 23*b*, wherein the dividing surface between both halves extends centrally through the passages 24. Here, the two halves 23*a*, 23*b* of the shrinking body are held on each other by securing means that have an upper securing surface 26*a* and a lower securing surface 26*b* that are secured releasably to each other by rods 26*c*.

Optimal securing results and sleeve shapes are achieved if the shrink sleeve 3, outside the glue area 27, is held open by mechanical brace 28 that completely or partially prevent shrinkage.

The shrink sleeves can be produced by a method in which a tube of considerable length, in particular an endless tube, is produced whose material consists alternately of shrinkable plastic and non-shrinkable or low-shrink plastic, and this tube is then divided or cut into the individual shrink sleeves 3. In this way, shrink sleeve shapes are obtained as shown in FIG. 1 or FIG. 11.

Figure 11:
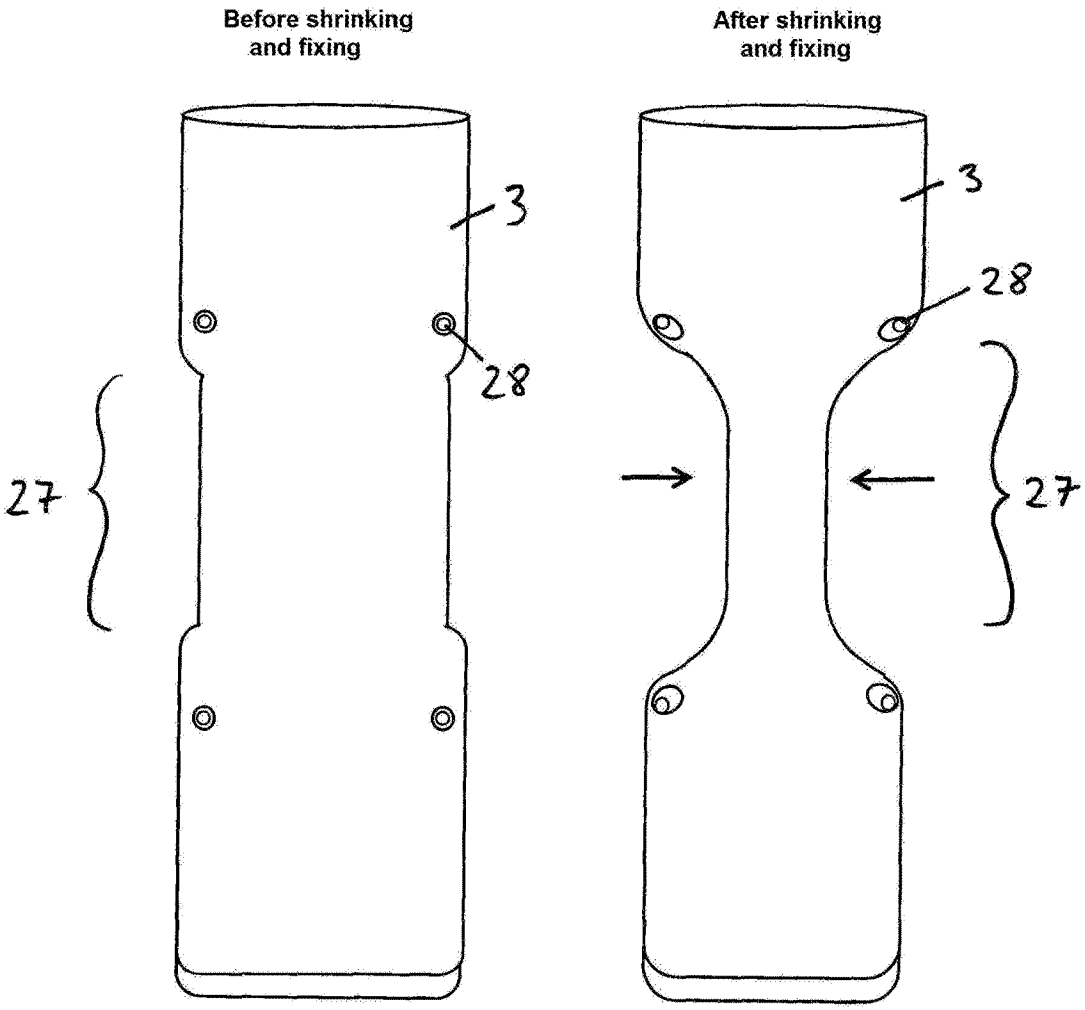
FIG. 11 is two side views of a shrink sleeve that shrinks only in the glue area.

The shapes according to FIG. 11 can also be achieved by the fact that a support apparatus 29 is located inside the shrink sleeve, at least in the glue area 27, which support apparatus 29 holds the shrink sleeve 3 in its wider, non-shrunken state and yields and/or is removed after the person's own hairs E have been pulled in. In the configuration shown in FIG. 11, these brace 28 are pins 28 that pass through the shrink sleeves on both sides near the glue area.

An alternative embodiment is one in which the mechanical brace 28, 29 are a split sleeve or a coil. Here, the support apparatus can be the sleeve-shaped glue 2. The mechanical brace 28, 29 are preferably formed by a split sleeve or a coil made of plastic or metal.

In an embodiment not shown, the support apparatus, by which the shrink sleeve 3 is held apart or spread open in the glue area 27, is formed by the sleeve-shaped glue 2, such that the glue 2 has a dual function. On the one hand, the sleeve-shaped glue 2 keeps the shrink sleeve 3 spread apart, in order then to yield, when heat is applied, and to be pressed together by the shrink sleeve 3 to the hairs 1 and E, and, on the other hand, the glue 2 ensures an adhesive connection of the hairs to one another.

In a further embodiment, the material chosen for the shrink sleeve is a plastic that, when heat is applied, additionally or alternatively shrinks in its longitudinal direction or reduces the length of the shrink sleeve 3, as a result of which the glue is pressed into the hairs that are to be connected.

The application of heat to the shrinking body 23 and/or to the shrink sleeve 3 is effected either by heat being applied from outside or by the shrinking body 23 and/or the shrink sleeve 3 having heating elements that cause the shrinkage of the plastic.

Figure 12:
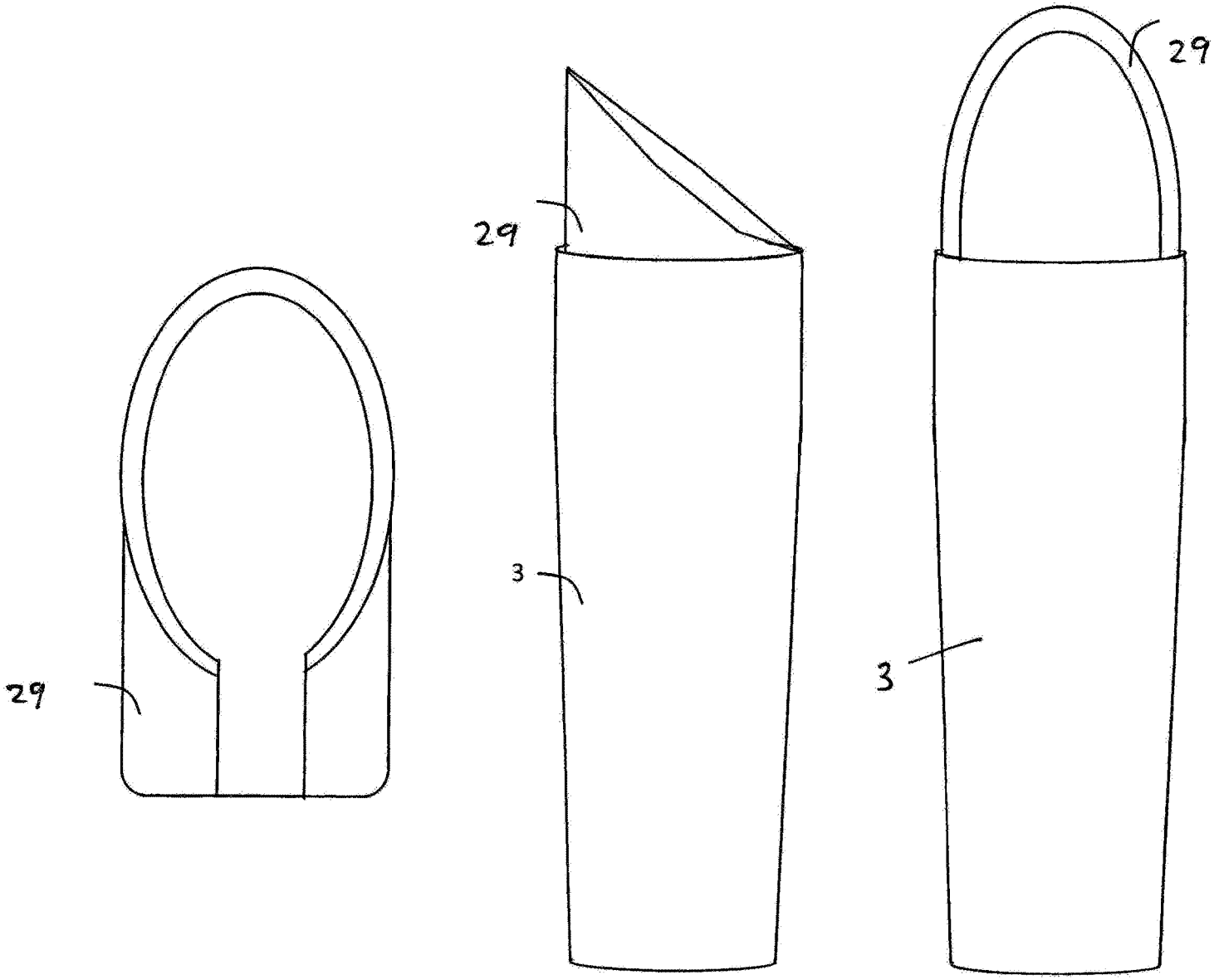
FIG. 12 shows a support apparatus outside and inside the shrink sleeve.

FIG. 12 shows a split support apparatus 29 that is inserted into one or both ends of the shrink sleeve 3 in order to prevent the end areas from shrinking until the removal of said apparatus.

The invention claimed is:

1. A method of extending a person's own hairs with foreign hair strands, the method comprising the steps of sequentially:

attaching the foreign hair strands to a tubular glue sleeve; feeding the person's own hairs through the glue sleeve and thereby overlapping the person's own hairs with the foreign hair strands of the glue sleeve at a hair-connection site;

heat-shrinking the shrink sleeve to heat and activate glue of the glue sleeve and thereby bond the foreign hair strands with the person's hairs at the hair-connection site; and immediately after shrinkage of the shrink sleeve, tearing open the shrink sleeve and then removing the shrink sleeve from the connection site while leaving the person's own hairs attached by the glue to the foreign hair strands.

2. The method defined in claim 1, further comprising the step of:

providing at least at one end of the shrink sleeve with a projecting grip tab on both opposite sides and flanking the break point for tearing open and removing the shrink sleeve.

3. The method defined in claim 1, further comprising the step of:

providing ends closer to the person's head with a glue accumulation located as a prefabricated glue head having the shape of a solid profile or of a glue sleeve that fits coaxially with a form fit or force fit in the shrink sleeve.

4. The method defined in claim 3, further comprising the step of:

mechanically stretching a plastic material of the shrink sleeve at least in the area of the glue accumulation in the glue sleeve.

5. The method defined in claim 1, further comprising the step of:

pulling with a hook wire whose width is equal to or smaller than an inner cross section of the shrink sleeve the person's own hairs through the shrink sleeve.

6. The method defined in claim 1, further comprising the steps of:

providing prior to the overlapping step a support inside the shrink sleeve to hold the shrink sleeve in a wider, non-shrunken state; and removing the support after the person's own natural hairs overlapped in the shrink sleeve with the foreign hair strands.

7. The method defined in claim 1, further comprising the step of:

providing the shrink sleeve with heating elements for shrinking the sleeve.

8. The method defined in claim 7, wherein the support is the glue sleeve and is removed by being melted to activate the glue.

* * * * *